US005752696A

United States Patent [19]

Nakatani et al.

[11] Patent Number: 5,752,696

[45] Date of Patent: May 19, 1998

[54] TRAY FOR LOADING SHEETS IN A SHEET-PROCESSING APPARATUS HAVING AN ELASTIC FORCE MAINTAINING A LID IN AN OPEN POSITION

[75] Inventors: Noboru Nakatani, Rennes; Stéphane Michel, Montfort Sur Meu; Marie-Hélène Froger, Chateaugiron; Alexandre Dodge, Pace; Christophe Truffaut, Rennes, all of France

[73] Assignee: Canon Kabushiki Kaisha, Tokyo, Japan

[21] Appl. No.: 844,310

[22] Filed: Apr. 10, 1997

Related U.S. Application Data

[63] Continuation of Ser. No. 548,960, Oct. 27, 1995, abandoned.

[30] Foreign Application Priority Data

Oct. 28, 1994 [FR] France ..... 94 12995

[51] Int. Cl.[6] ..... B65H 1/08

[52] U.S. Cl. ..... 271/127; 271/160; 271/157; 271/170

[58] Field of Search ..... 271/157, 126, 271/127, 145, 160, 162, 164, 170; 221/227

[56] References Cited

U.S. PATENT DOCUMENTS

| | | | |
|---|---|---|---|
| 4,406,448 | 9/1983 | Kulpa et al. | 271/160 |
| 4,772,007 | 9/1988 | Kashimura . | |
| 5,181,712 | 1/1993 | Perino | 271/127 X |
| 5,346,197 | 9/1994 | Takano et al. | 271/127 X |

FOREIGN PATENT DOCUMENTS

| | | | |
|---|---|---|---|
| 0591612 | 4/1994 | European Pat. Off. . | |
| 88732 | 8/1978 | Japan | 271/126 |
| 55031 | 3/1986 | Japan | 271/126 |
| 60535 | 3/1986 | Japan . | |
| 162430 | 7/1986 | Japan | 271/160 |
| 111836 | 5/1987 | Japan | 271/145 |
| 2061231 | 5/1981 | United Kingdom . | |

*Primary Examiner*—Boris Milef

*Attorney, Agent, or Firm*—Fitzpatrick, Cella, Harper & Scinto

[57] ABSTRACT

A tray for a sheet processing apparatus having a receptacle, a lifting plate movable between a low position and a high position, an elastic member for elastically moving the lifting plate to the high position from the low position, a lid mounted on the receptacle pivoting about an axis and movable between an open position and a closed position, and a pushing member for pushing the lifting plate toward the low position against an elastic force of the elastic member when the lid moves into the open position, and characterized in that the pushing member is mounted on the lid and maintains the lid in the open position against the elastic force of the elastic member.

28 Claims, 8 Drawing Sheets

TRAY FOR LOADING SHEETS IN A SHEET-PROCESSING APPARATUS HAVING AN ELASTIC FORCE MAINTAINING A LID IN AN OPEN POSITION

This application is a continuation of application Ser. No. 08/548,960 filed Oct. 27, 1995, now abandoned.

BACKGROUND OF THE INVENTION

The present invention generally relates to a tray for loading sheets into a sheet processing apparatus.

As the sheet processing is situated downstream the loading tray in the apparatus, here by sheet "processing" will be understood:

- the reading or the analysis of information borne by the sheets,
- the formation of images on the sheets, for example by printing, and
- more generally any use or transformation of the sheets by the processing device situated dowstream the tray.

The present invention more particularly relates to a sheet loading tray for an image forming apparatus such as a telecopier.

In the prior art there exist numerous sheet loading trays, intended for image-forming apparatuses such as photocopiers, printers or telecopiers.

A known loading tray in particular has:

- a bin, having an overall parallelepipedic shape and open at its upper face, intended to receive the sheets of paper;
- a lifting plate arranged at the bottom of the bin and movable between a low position and a high position, this lifting plate being pivoted about an axis parallel with the bottom of the bin; and
- a lid pivoted on the bin about an axis, movable between an open position and a closed position, and arranged to cover, at least partially, the bin, this lid having to be removed in order to allow the loading of the sheets.

The lifting plate is suitable for cooperating with an elastic thrust member tending to return it to its high position. According to the models of trays and image-forming apparatuses, the elastic thrust member may be integrated in the tray or integrated in the image forming apparatus and act on the lifting plate through an opening provided in the bottom of the bin.

Such trays at present exist in several versions.

They are generally satisfactory with respect to their essential function, i.e. storing the paper and allowing it to be fed sheet by sheet to the image forming apparatus.

However they have a certain number of drawbacks, which are essentially connected with the fact that the sheet replenishing operation by the user is not always easy.

First of all in order to load the sheets the user has to remove the cover.

Furthermore, when the elastic thrust member is integrated in the tray, in order to return the lifting plate to its high position, during the loading of the paper, the user himself has to exert a thrust in opposition to the said elastic thrust member. This operation is not very practical.

To overcome these drawbacks, in certain versions of trays, an example of which is described in U.S. Pat. No. 4,772,007, the lid is pivotably mounted on the bin about a shaft. As shown on FIG. 4 of this patent, the lifting plate is bent at its end opposite the end urged by the elastic thrust member so that a portion thereof protrudes from an opening formed in the bottom of the bin. This portion is intended to cooperate with a release cam rotatably supported by the aforementioned shaft.

Thus, when the lid is pivoted about the shaft, to its open position for loading sheets in the bin, the release cam also rotates and by the cam surface thereof the lifting plate is pivoted to its low position to thereby permit a bundle of sheets to be loaded easily (see FIGS. 4 and 6 of the above patent in this respect).

This tray is generally satisfactory as long as the loading of sheets is effected with the tray mounted on the sheet processing apparatus in a position near the vertical.

However, such a tray is rather difficult to load with sheets when positioned horizontally, e.g. when the sheet processing apparatus is adapted to receive the tray horizontally or when the loading is to be effected with the tray being out of the apparatus.

As a matter of fact, in such a case, a user will be lead to hold the lid in the open position to avoid its tilting to the closed position under the effect of its own weight while loading sheets in the bin. One will understand that this is not easy, notably for a less trained user, who furthermore risks to damage the sheets during the loading.

It will moreover be noted that the arrangement disclosed in the above U.S. Pat. No. 4,772,007 for lowering the lifting plate through the opening of the lid is of a rather complex constitution.

The present invention enables the above-mentioned drawbacks to be resolved.

SUMMARY OF THE INVENTION

According to one aspect, it proposes a tray for loading sheets for a sheet-processing apparatus having a receptacle, a lifting plate movable between a low position and a high position, an elastic member for elastically moving the lifting plate to the high position from the low position, a lid mounted on the receptacle pivoting about an axis and movable between an open position and a closed position, and pushing means for pushing the lifting plate toward the low position against an elastic force of the elastic member when the lid moves into the open position, characterised in that said pushing means is mounted on said lid and maintains the lid in the open position against the elastic force of the elastic member.

Thanks to these provisions, the lifting plate is automatically positioned in its low position by the pushing means, the receptacle then being ready to receive its maximum load of sheets, pushing means which at the same time maintains the lid in the open position against the elastic force of the elastic member Thus, the user no longer has to exert any thrust on the lifting plate, or to hold the lid in its open position during the loading of the paper.

In a preferred embodiment of this aspect of the invention, the pushing means comprises an arm integral with the lid, said arm pushing down the lifting plate when the lid moves into the open position.

The mechanical structure of this pushing means is very simple.

Moreover, such a pushing means is not only considerably more compact than the arrangement of the prior art mentioned above, but also of reduced cost to realize. It therefore makes it possible to produce a sheet loading tray that is itself more compact and less costly than the tray of the prior art.

Advantageously, the elastic force of the elastic member urges the lid toward said open position, and said lid is maintained at the open position.

In the preferred embodiment, said receptacle comprises an abutment portion which is abutted by the lid at the open position of the lid, the elastic force of the elastic member urging the lid towards said abutment portion via said lifting plate and said arm so that said lid is maintained at the open position.

In other respects in the prior art, the sheet reloading operation is not simple as the user has to estimate a maximum number of sheets of paper in a pile before placing them in the bin.

Moreover, once the sheets are placed in the bin, the user is forced to manipulate it in order to introduce the tray into the image forming apparatus, at its location. A less careful user may, during this manipulation, shake the tray so that the upper sheets of the pile disposed in the bin run the risk either of protruding beyond or of escaping through the rear end, or of protruding beyond or escaping through one of the lateral edges. In this case, there is a risk of feed anomalies, because of the squeezing of the sheets between the lid and the bin, resulting either in an absence of sheet feeding or, on the contrary, in the feeding of two or more sheets at the same time. There is also a risk of paper becoming jammed in the image forming apparatus. Furthermore, if the sheet is not correctly held between the lateral edges of the bin, it risks being grasped the wrong way by the image forming apparatus, affecting the quality of the image formed on the sheet.

The present invention moreover enables the above-mentioned drawbacks to be resolved and the paper loading operations to be simplified.

According to another aspect of the present invention the lid has at least one limitation area arranged so that, when the lid is in the open position, the limitation area is at a predetermined distance from the bottom of the receptacle, corresponding to the maximum thickness of paper capable of being loaded in the tray.

In a preferred embodiment, the limitation area is formed by a ridge on the lid arranged in the vicinity of the axis of this lid.

Thanks to these provisions, the limitation area, advantageously formed by the ridge, is automatically positioned when the lid is opened. The user thus has at his disposal a visual reference in order to determine at first the height of the packet of sheets which he may load into the receptacle, advantageously a bin. Moreover, the limitation area, advantageously formed by the said ridge, also acts as a limiter which physically prevents the user from loading more paper than the tray can contain without having the feeding errors mentioned above.

According to yet another of its aspects, the present invention is characterised in that the tray includes prevention means designed to prevent the passage of sheets between the lid and the receptacle, in the closed position of the lid. In a preferred embodiment, these prevention means include at least one clearance arranged on the periphery of the receptacle facing the lid, and at least one plane limitation area arranged on the periphery of the lid and parallel to the bottom of the receptacle when the lid is closed, the plane limitation area being offset with respect to the internal surface of the lid and arranged on a support structure integral with the lid, this structure being positioned so that, in the closed position of the lid, it enters the said clearance, the said plane limitation area opening onto the inside of the receptacle.

Thanks to these provisions, in a general manner the sheets are prevented from protruding beyond or escaping through the peripheral junction between the receptacle and the lid on the occasion of the above-mentioned manipulation of the tray.

Preferably, when the receptacle and the lid have a front end and a rear end, the rear end of the receptacle has at least one rear clearance, while the rear end of the lid has at least one rear plane limitation area.

Here, the possible movement of the sheets is limited, on the one hand, upwardly because of the rear plane limitation area. It is, on the other hand, limited towards the rear by the inner rear end of the receptacle, advantageously formed by the rear wall of a bin. Thus during the manipulation of the tray, after loading the paper therein, the upper sheets are prevented from protruding beyond or escaping from the rear end.

Preferably and in a similar manner, when the receptacle and the lid have lateral edges, each of the lateral edges of the receptacle has at least one lateral clearance while each of the lateral edges of the lid has at least one plane lateral limitation area.

Here too, during the manipulation of the tray, after loading the paper therein, the upper sheets are prevented from protruding beyond or escaping from the sides. In fact, the possible movement of the sheets is limited in the same manner as has just been described for the rear end.

Risks of jamming and absence of feed are avoided and the sheet arrives in the printing area, when it concerns an image forming apparatus, with correct positioning, guaranteeing the quality of the printed image.

When the receptacle is advantageously formed by a bin, the clearance is a notch provided in a corresponding wall of the bin.

The present invention also proposes an image forming apparatus comprising a tray as defined above, feeding means for separating and feeding the sheet from said tray, and printing means for printing an image to the sheet fed by said feeding means.

The characteristics and advantages of the present invention will moreover become apparent from the following description with reference to the attached drawings on which:

DETAILED DESCRIPTION OF THE PREFERRED EMBODIMENT

Figure 1:
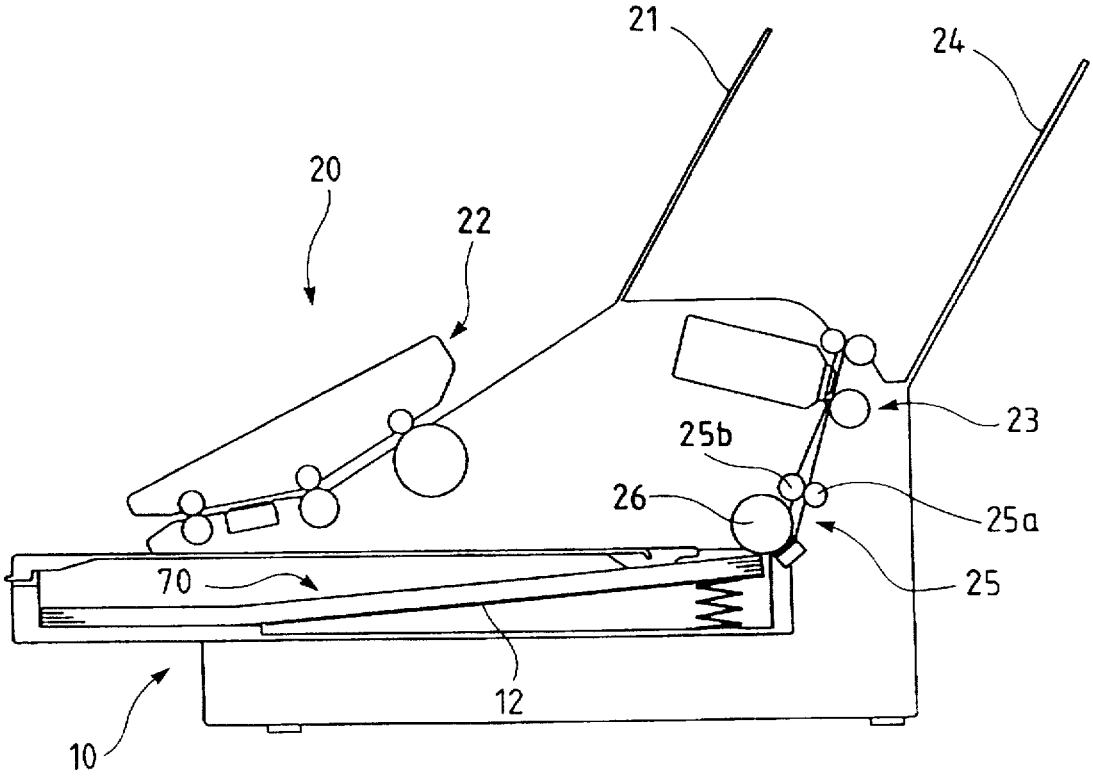
FIG. 1 is a diagrammatical elevational view illustrating a telecopier equipped with a paper loading tray in accordance with the invention.

According to the chosen embodiment represented in the figures, a tray 10 in accordance with the invention is arranged in a telecopier represented under the general reference 20. It will be noted that the telecopier is an image forming apparatus capable of receiving the tray 10. Other image forming apparatuses such as printers and photocopiers may obviously be suitable, and also sheet processing apparatuses such as those specified above.

The telecopier has, in the conventional manner, a support plate 21 for documents to be sent, a reading area diagrammatically shown under reference 22, a received document printing area 23 and a support plate 24 for documents printed.

The tray 10, which is intended to receive the paper on which the documents received will be printed, cooperates with a device 25 for separating the sheets loaded into the tray and for transporting them towards the printing area 23.

The device 25 has, in the conventional manner, a roller 26 for driving and seizing the sheets loaded into the tray, the tray having, as will be described below, elastic thrust means intended to bring the upper sheet of the pile of paper 70 loaded in the tray into contact with the roller 26.

The device 25 also has sheet transport rollers 25*a*, 25*b* arranged downstream of the roller 26.

The means 21–26 have a structure well known to the man skilled in the art and already used in telecopiers; the invention concerns in this particular case the tray 10. These means 21–26 will consequently not be described in further detail here.

A preferred embodiment of a tray in accordance with the invention will now be described with the assistance of FIGS. 1 to 10.

The tray illustrated comprises a bin 11 forming the receptacle intended to enclose, firstly, various means of the invention and, secondly, to contain the sheets of paper.

The tray 11 has an overall parallelepipedic shape, with its interior space being capable of receiving a pile 70 of paper of predetermined format (A4 format in this embodiment). The tray also has a lifting plate 12 movable between a low position (FIGS. 2, 3 and 5) and a high position (FIGS. 1, 4 and 6).

In accordance with the invention, the lifting plate 12 is suitable for cooperating with an elastic thrust member or elastic member tending to return it to the high position.

In the chosen embodiment represented, the elastic thrust member is integrated with the tray and is present in the form of a coil spring 30. In other embodiments, it will be possible for the elastic thrust member to be present in other forms and to be integrated with the image forming apparatus, the important point being that its arrangement enables it to cooperate with the lifting plate of the tray in accordance with the invention, in order to return this plate elastically to its high position.

Figure 2:
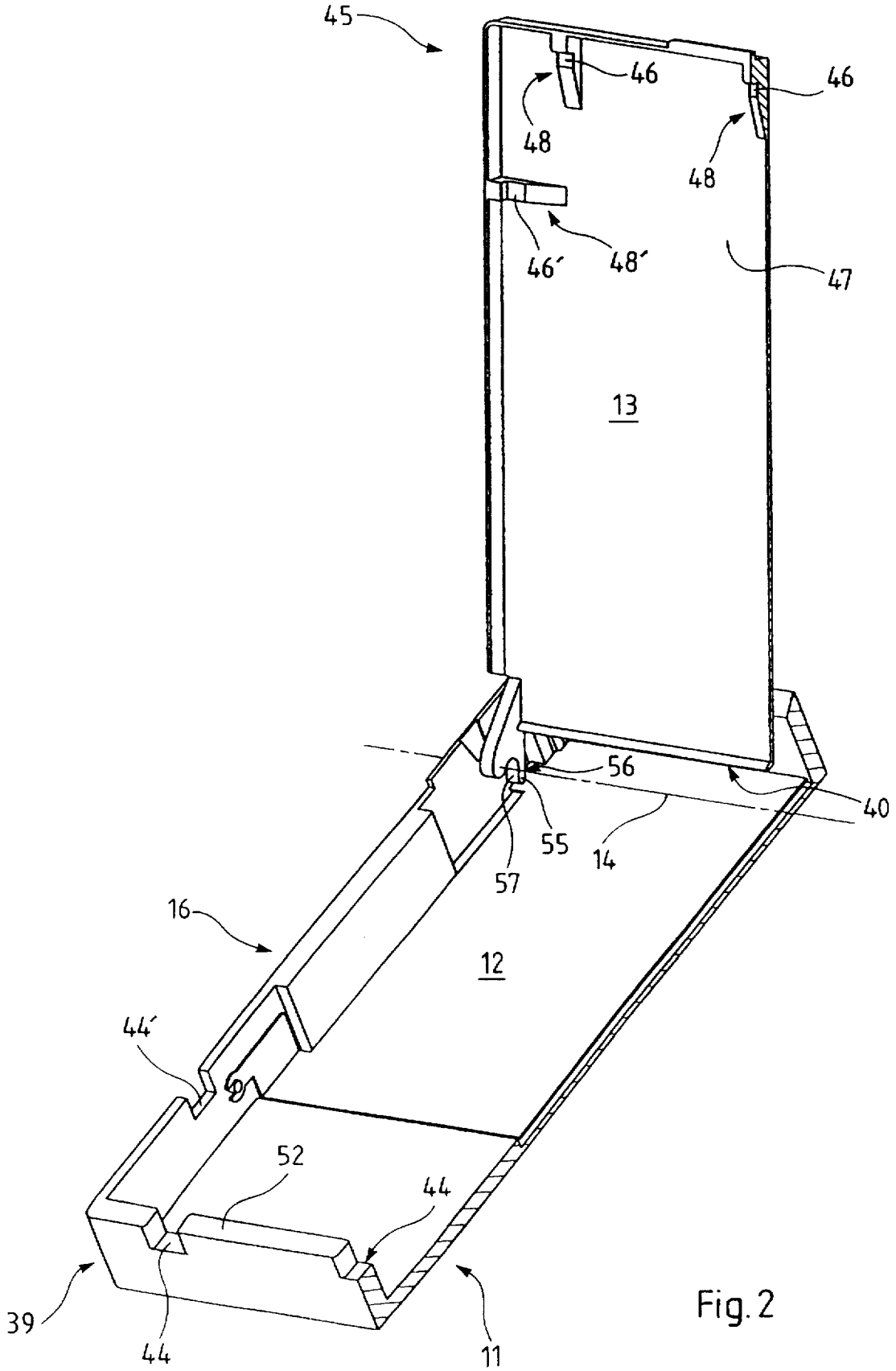
FIG. 2 is a perspective view with a partially cut-away portion of the tray illustrated in FIG. 1.

In the chosen embodiment represented, the lifting plate 12 is mounted pivoted on the structure of the bin 11, and more particularly on its longitudinal sides or longitudinal walls, with only one of these, side 16, being visible in FIG. 2, because of the partially cut-away portion provided so that the invention can be better understood.

More precisely, in this embodiment the plate has a front end 31 and a rear end 32, the length of the plate here being substantially less than that of the sheets. At the level of the rear end 32, the plate 12 has two mounting lugs 33 arranged on each side of the plate and themselves bearing a notch 35 each suitable for receiving a pivot 36 integral with the side 16, the pivot 36 and the notch 35, arranged on either side of the lifting plate 12, producing the pivoting of said plate on the bin 11.

In this embodiment, the spring 30 is arranged in the vicinity of the front end 31 of the lifting plate, in order to be compressed between said plate and the bottom 37 of the bin 11. It is held in place by means which have not been represented on the figures in order to facilitate the understanding thereof and which can easily be performed by a man skilled in the art.

A lid 13 is also hinged on the bin 11 about an axis 14 (FIGS. 2 and 3) and is intended to cover partially the bin. The means producing this rotation in this embodiment will be described later, with the aid of FIG. 9.

In the remaining description, for convenience the end of the tray with the reference 38 will be designated as "front end" or "feeding end", while the end with the reference 39 will be designated as "rear end".

Figure 5:
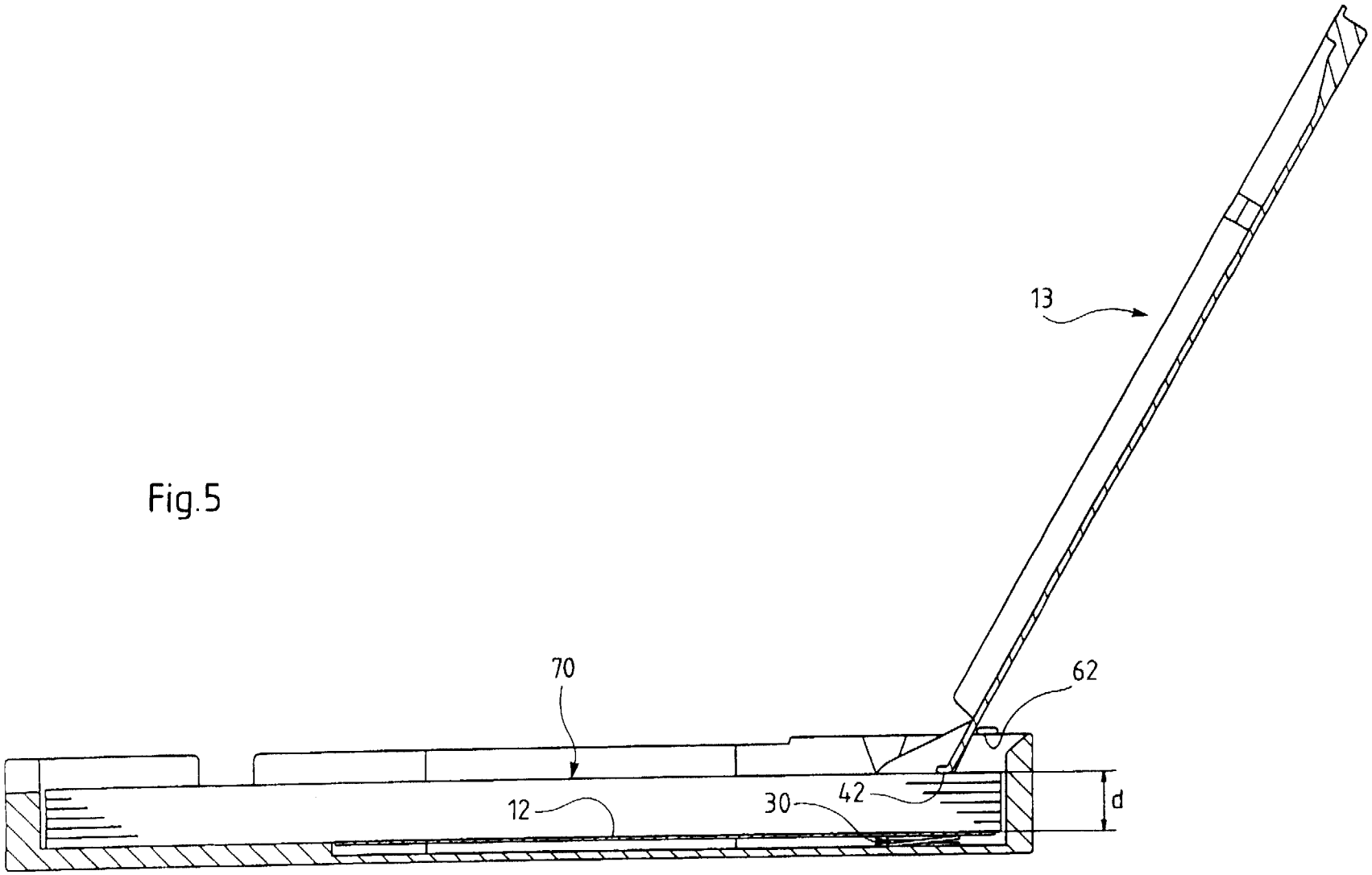
FIG. 5 is a view corresponding to FIG. 3, illustrating the tray loaded with paper.
Figures 6, 6A:
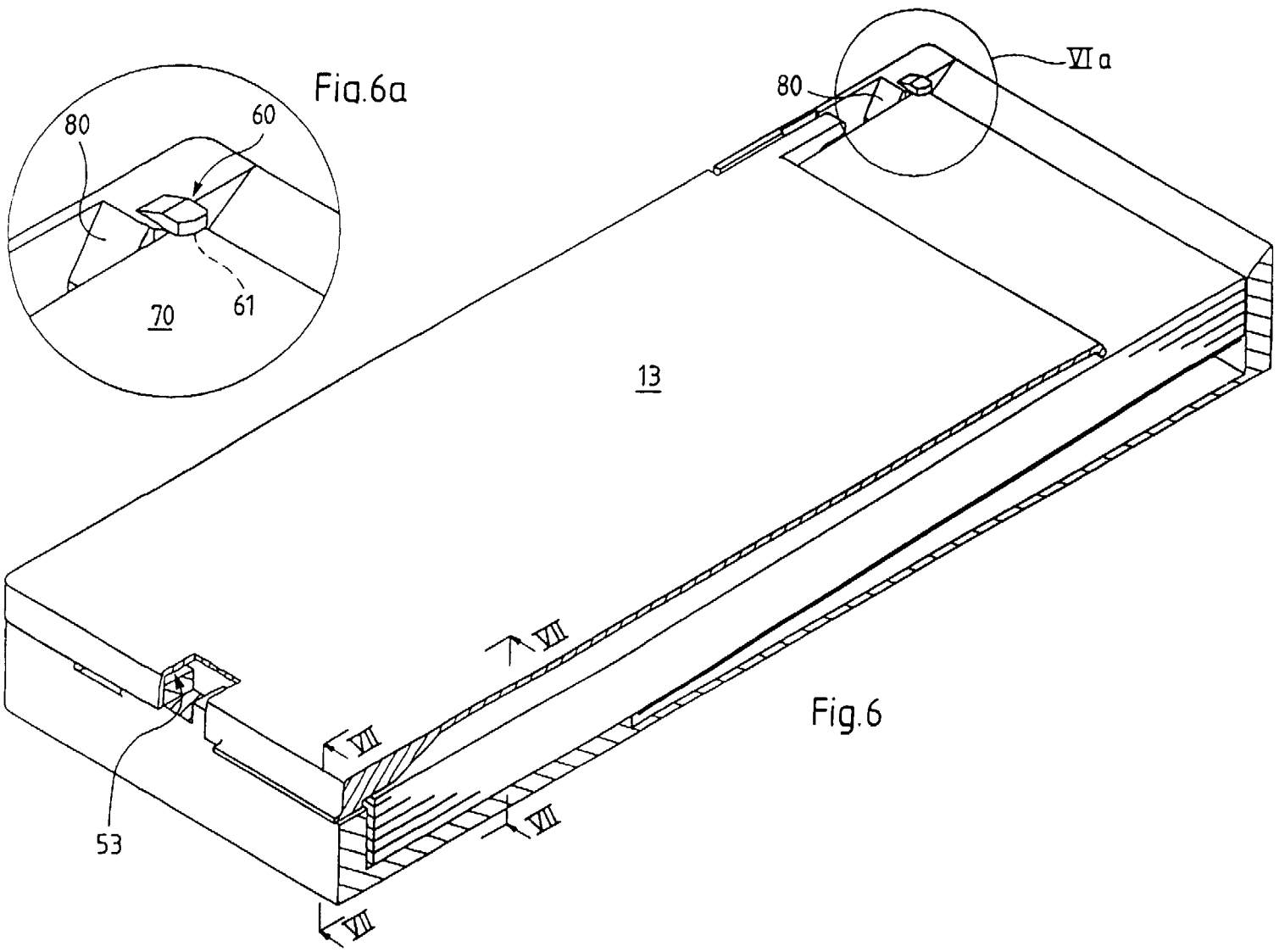
FIG. 6 is a perspective view of the tray with a partially cut-away portion, the lid being illustrated in its closed position.
FIG. 6*a* is an enlargement of the inset VI*a* of FIG. 6.

In accordance with the invention, the lid has at least one limitation area 40 so that when the lifting plate is in the low position (FIGS. 2, 3) and when the lid is in the open position (also FIGS. 2 and 3), the limitation area 40 is at a predetermined distance d from the bottom 37 corresponding to the maximum paper thickness 70 capable of being loaded into the tray (FIG. 5).

As, in the low position, the lifting plate 12 comes to lie on the same level as the bottom 37, here this predetermined distance is also that between the limitation area 40 and the lifting plate 12.

In the embodiment, and in accordance with another advantageous characteristic of the invention, the limitation area is formed by a simple ridge 41 on the lid arranged on the latter in the vicinity of the axis of rotation 14.

In the chosen embodiment represented, the ridge 41 is arranged to have a contact surface 42 having a substantial width, so as not to damage the sheet on the top of the pile 70 (FIG. 5). The ridge 41 may, in other embodiments, have another physical shape and be rounded, for example. Here it extends over the entire width of the lid.

In operation, the loading tray described here has proved to be more practical during the sheet loading operations than that in the prior art given in the preamble.

In fact, first of all, in accordance with a characteristic of the invention, in normal operation the lid 13 is integral with the bin, since in this particular case it is hinged on the latter. The user does not have to detach this lid as for some prior art. It is sufficient for him to bring it into its open position (FIGS. 2 and 3) which automatically positions the ridge 41 (in this particular case the surface 42) at the distance d above the bottom 37 or the lifting plate, when said plate is in the low position.

The user thus has a visual reference in order to determine the maximum paper height. He only has to slide the pile 70 into the space left free between the lifting plate 12 and the surface 42, the lifting plate being able to be kept in its low position either because of pressure exerted by the user, or automatically, by means of the arrangement which will be described below.

It will be observed in particular that the limitation area acts as a limiter which physically prevents the user from loading more paper than the tray can contain.

After loading the sheets, the user now only has to fold down the lid, which for him is a simpler operation than the remounting of the lid which he had to perform with some of the prior art.

A second aspect of the invention advantageously used in the chosen embodiment represented in the figures will now be described.

Figure 7:
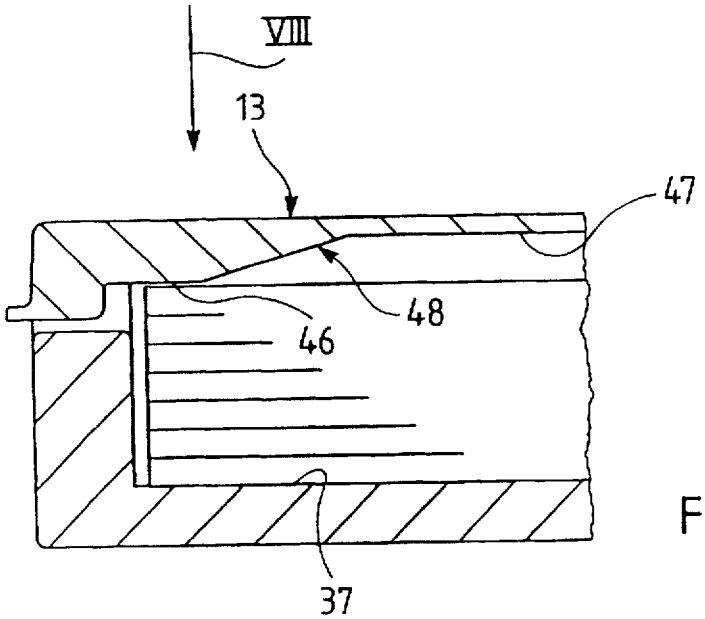
FIG. 7 is a partial sectional view along the plane VII of FIG. 6 and along line VII—VII of FIG. 8.
Figure 8:
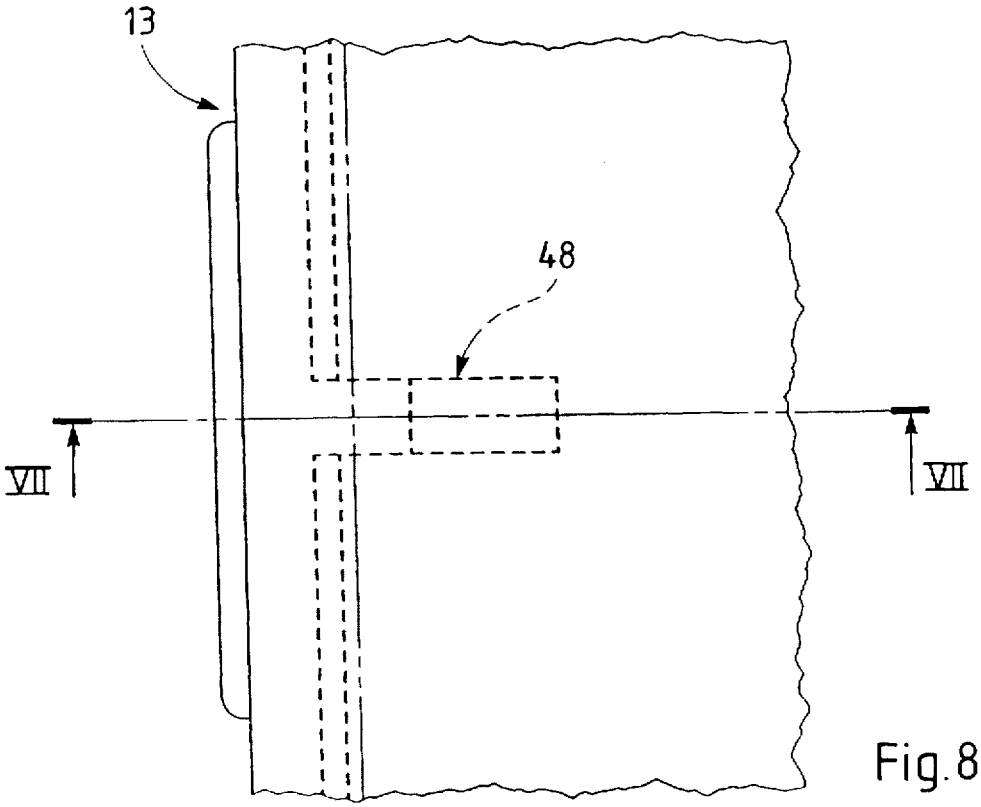
FIG. 8 is a view along arrow VIII of FIG. 7.

In accordance with this aspect of the invention, the rear end 39 of the bin 11 has at least one rear notch 44, forming a clearance, while the rear end 45 of the lid 13 has at least one rear plane limitation area 46, which is parallel to the bottom 37 of the bin (when the lid 13 is closed), the plane area 46 being offset with respect to the inner surface 47 of the lid and arranged on a support structure 48 integral with the latter. The support structure 48 is positioned so that, in the closed position of the lid 13, it enters the notch 44, the rear plane limitation area 46 then opening on the inside of the bin 11 (FIGS. 4 and 7).

In this embodiment, the bin includes three notches at the rear end, while the lid has three support structures 48 for rear plane limitation areas 46, a single support structure and a single notch being entirely represented on FIG. 2 (only half of the second notch-structure unit being represented, because of the partially cut-away portion of FIG. 2). In other respects it is recalled that with respect to the cut-away plane, the bin 11 illustrated on FIG. 2 is symmetrical.

In the chosen embodiment represented, the support structure 48 is formed by a bulge having the shape illustrated on the figures. A slope 54 is provided in front of the surface 46 in order to avoid damaging the corners of the sheets. This bulge is set in the mass of the material of the lid. FIG. 7 enables the function of the plane limitation area to be understood. On this FIG. 7 it is observed that when the lid 13 is in the closed position the rear plane limitation area 46 is situated parallel to the bottom 37 of the bin. This surface 46 acts as an abutment surface on which the upper sheet of the pile 70 comes to bear, on the assumption that during the manipulation of the loaded tray, said tray is overturned, the sheets then tending to fall on account of gravity.

Therefore the upper sheet can not move in the direction of the inner surface 47 of the lid 13.

In other respects, the fact of disposing the surface 46 on a structure 48 so that this surface 46 is considerably offset with respect to the inner surface 47 of the lid enables, by providing the complementary notches 44 on the rear end wall 51 of the bin, an interlocking of the support structures 48 with the wall 51 to be achieved, during the closing of the lid 13. Thanks to this characteristic, the sheets, and in particular the upper sheet of the pile 70, can not slide in the gap 53 capable of existing between the inner face 47 of the lid 13 and the free upper edge 52 of the wall 51 (see the partial cut-away portion on FIG. 6 in which the gap in question bears the reference 53). In fact, if a plane abutment surface 46 considerably flattened with respect to the inner face 47 and "opening" on the inside of the bin, as visible in particular in FIG. 4, were not provided, the upper sheets of the pile 70 would be capable of sliding in the gap 53 and, for example, of being squeezed between the inner face 47 and the free upper edge 52. This would have the effect of preventing the upper sheet of the pile being driven by the roller 26. This second aspect of the invention advantageously allows this drawback to be removed.

This provision also allows certain cases of jamming to be avoided, which have been observed by the applicant. In fact, if the upper sheet of the pile 70 comes to enter the gap in question and to be squeezed, the drive roller 26 may entrain the second sheet towards the separation and transport device 25, this sheet in turn driving the first sheet by friction. The result of this is that two sheets are driven towards the printing device 23.

Thus thanks to the invention, the user may manipulate the tray as soon as it is loaded without the fear of seeing certain sheets pinched by the lid with the above-mentioned drawbacks.

Similarly, a lateral plane limitation area 46' parallel to the bottom 37 of the bin is also provided (when the lid 13 is closed). This lateral plane area 46' is also offset with respect to the inner surface 47 of the lid and arranged on a support structure 48' integral with the latter. This support structure 48' is also positioned so that in the closed position of the lid 13, it enters a lateral notch 44' acting as a clearance, the lateral plane limitation area 46' then opening on the inside of the bin 11.

In this embodiment, the bin has two notches of this type, each provided in a lateral wall or side 16 of the bin 11, while the lid has two support structures 48' for the lateral plane areas 46', a single lateral support structure and a single lateral notch being entirely represented on FIG. 2 (the other lateral notch-lateral structure unit not being represented on the figures because of the sections and partial cut-aways featured on these). As for the rear support structure 48, the lateral support structure 48' is also formed by a bulge having the shape illustrated on the figures. A slope is also provided in front of the surface 46'.

The functions of the lateral plane limitation area 46' and the lateral support structure 48' are the same as those given above for the rear plane limitation area-rear support structure unit. As already mentioned, the risks of jamming and of absence of feed in particular are avoided.

But furthermore, the top sheet of the pile is correctly held between the lateral walls of the bin 11, when it is driven and it has left the plane rear limitation areas. In fact, as long as this upper sheet is only grasped by the roller 26, but not yet by the transport rollers **25*a*, 25*b*, a displacement of the rear of this sheet towards the one or the other of the walls of the bin 11** is always possible.

The sheet therefore arrives in the printing area with more precise positioning, guaranteeing a better quality of printed image.

The unit formed by these notches 44, 44' and support structures 48, 48' form prevention means designed to prevent the passage of sheets between the lid and the bin, these notches and structures being arranged respectively on the periphery of the bin and of the lid.

A fourth aspect of the invention advantageously used in the chosen embodiment represented in the figures will now be described.

Figure 3:
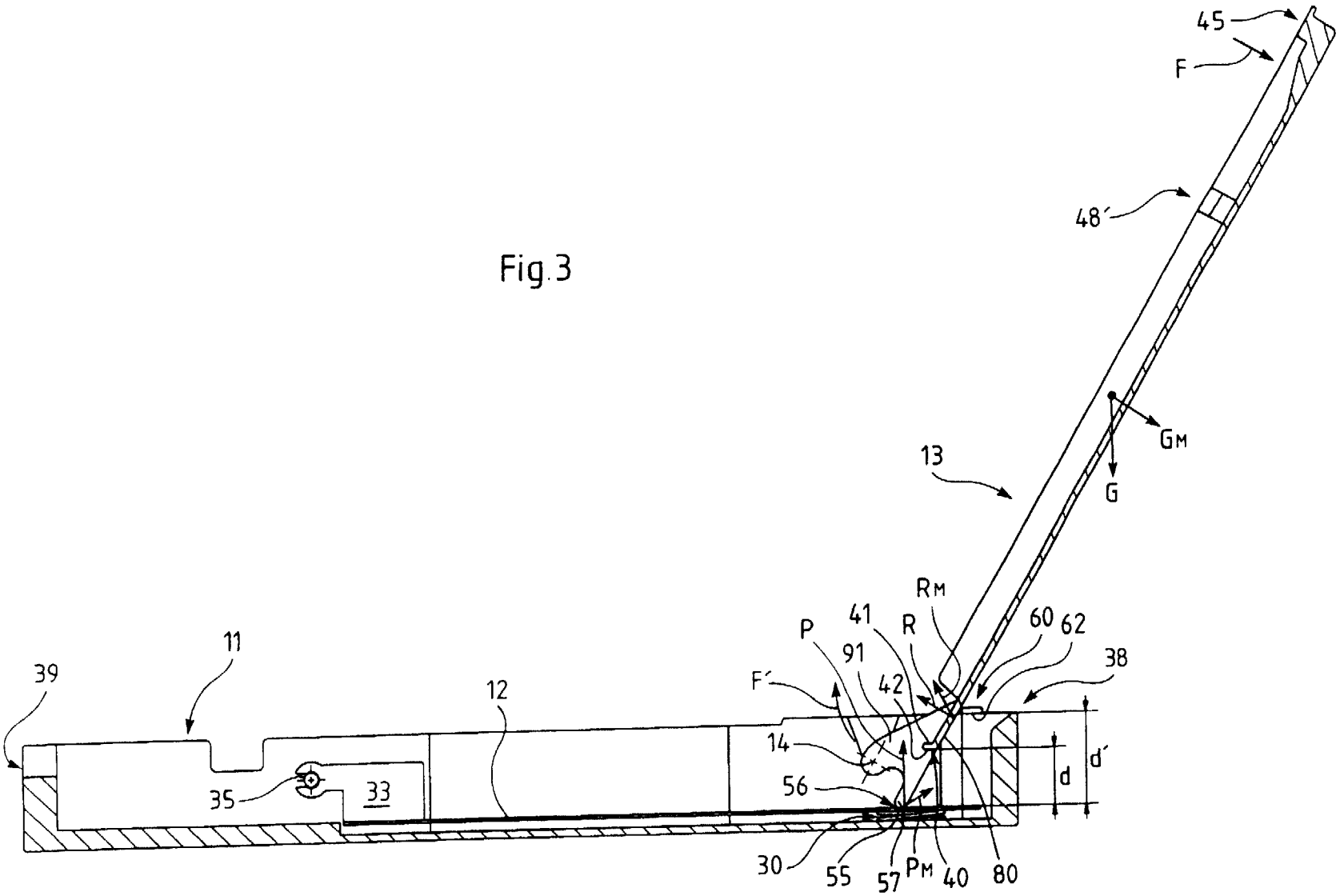
FIG. 3 is an elevational view in longitudinal section of the tray, the lid being illustrated in its open position.
Figure 4:
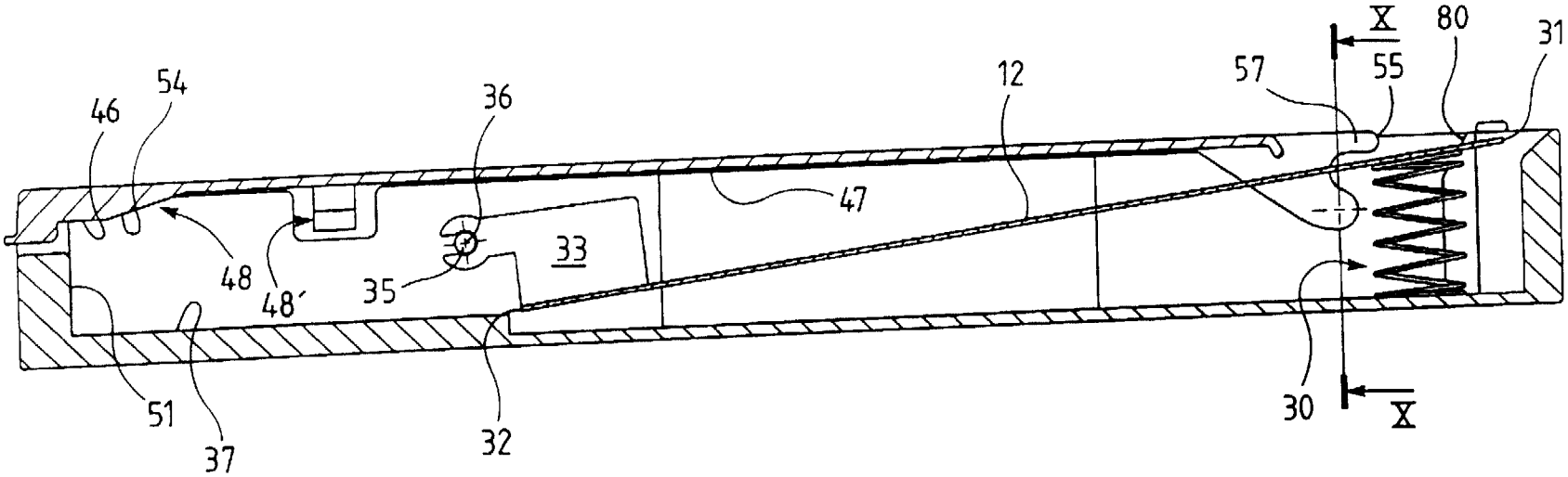
FIG. 4 is a view corresponding to FIG. 3, the lid being illustrated in its closed position.

According to this aspect of the invention, particularly visible in FIGS. 2 to 4, the lid 12 has at least one thrust area 55, while the lifting plate 12 has at least one bearing area 56, the thrust area and the bearing area being arranged so as to cooperate together so that, when the lid comes into its open position (FIGS. 2 and 3), the said thrust area 55 pushes the lifting plate towards its low position (FIG. 3) in opposition to the elastic thrust member (the spring 30).

In the chosen embodiment represented, according to a preferred embodiment of this aspect of the invention, the thrust area is a rounded surface arranged at the end of an arm 57 integral with the lid 13, while the bearing zone 56 is arranged on a lug integral with the lifting plate. As can be seen on FIG. 4, the arm 57 bearing the thrust area is provided at the front end of the lid 13, on the side thereof (the lid 13 has two of these arms, as it is symmetrical with respect to the cut-away plane of FIG. 2). Similarly, the lug bearing the bearing area of the lifting plate is arranged on the side of the latter, two of these lugs being in reality provided on either side of the lifting plate, in the vicinity of the front end thereof.

As can be seen on the figures, the arm 57 constituting the pushing means defined above is arranged on the lid 13 with respect to the axis 14 so that during the opening movement, the thrust area 55 provided at the end of the arm 57 comes into contact with the bearing area 56 then pushes the lifting plate 12 towards the bottom 37 of the bin, as illustrated in particular in FIGS. 2 and 3, and finally maintains the lid 13 in the open position against the elastic force of the spring 30.

Thanks to this provision, the user no longer has to push the lifting plate 12 manually or hold the lid in its open position when loading the paper. He simply has to open the lid.

More precisely, in the case of the preferred embodiment described here, the lid 13 is not maintained open by the arm 57 acting against the elastic force of the spring 30 in a substantially vertical position but in a position beyond the latter, in which this lid 13 abuts an oblique abutment 80 provided on the bin 11, the elastic force of the spring 30 urging the lid 13 toward the abutment 80 via the lifting plate 12.

Here again, the lid 13 is kept open. As a matter of fact, when referring to FIG. 3, one will observe that the corresponding elements of the tray are here arranged so as to satisfy the following relation $$G_M \geqq P_M + R_M$$

where:

$G_M$ is the moment around pivoting axis 14 of the weight G of the lid 13;

$P_M$ is the moment around pivoting axis 14 of the elastic force P of the spring 30 acting on the arm 57 via the lifting plate 12; and $R_M$ is the moment around pivoting axis 14 of the reaction force R acting on the lid 13 and due to the oblique abutment 80.

Of course, it is to be noted here that, on the basis of the above teachings, a man skilled in the art will be able to carry out other specific arrangements which will satisfy other relations than the one above, permitting to maintain the lid 13 in its open position.

A fifth aspect of the present invention advantageously used in the chosen embodiment represented on the figures will now be described.

According to this aspect of the invention particularly visible in FIGS. 6 and 6*a*, the bin 11 has two tabs 60 for holding the front corners 61 of the sheets 70. These tabs open onto the inside of the bin 11 and have a holding surface 62 arranged with respect to the lifting plate 12 at least at the same distance as that between the limitation area 40 and the bottom 37, here the lifting plate when it is in its low position, the said lid being open (FIGS. 3 and 5). On these figures, it can in fact be noted that the distance d existing between the surface 42 and the upper surface of the lifting plate 12 is less than the distance d' existing between the surface 62 and the lifting plate 12, when it is in its low position, the lid 13 being open.

The function of the holding tabs 60, and more precisely their holding surface 62, is as in the prior art, to hold the paper in the tray (FIGS. 6 and 6*a*), in particular after the loading operations, at the feeding end of the tray. However, in contrast to the prior art, during the positioning of the pile of paper 70 in the tray, there is no risk of damaging the front corners of certain sheets, since the user only has to slide the sheets beneath the surface 42. Furthermore, if the surface 62 is provided at a distance d' greater than the distance d, there is no risk during loading of seeing certain upper sheets of the pile 70 coming to abut against the tabs 60 and the corners being damaged as a result.

Figure 9:
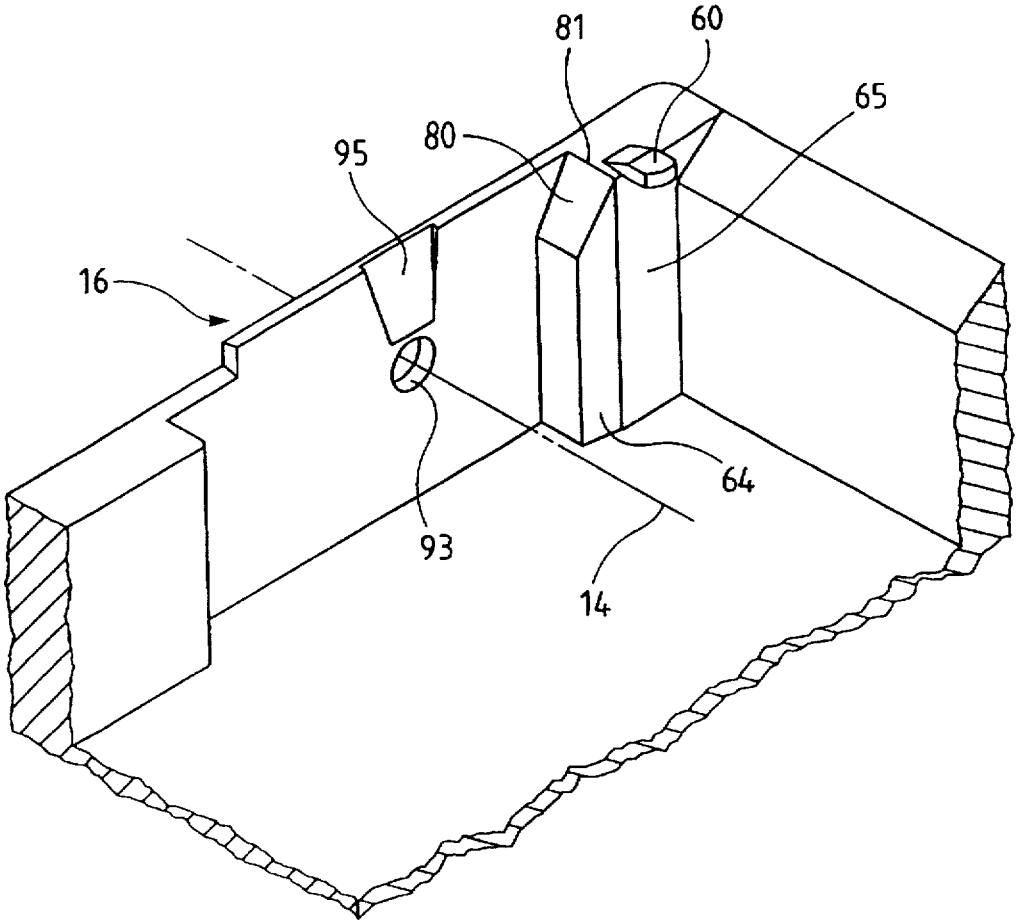
FIG. 9 is a detailed view of the front left part of the interior of the bin of the tray.

FIG. 9 shows that a vertically oriented guide surface parallel to the longitudinal axis of the tray is arranged directly below the holding surface 62 of each tab 60. On FIG. 9, which is a detailed view, the vertical guide surface bears the reference 65. Two of these surfaces are obviously provided, directly below each of the tabs 60, the guide surfaces 65 being spaced by a distance substantially greater than the width of the sheets. They are preceded by an obliquely oriented guide surface 64 having two functions:

firstly, the presence of a sharp limitation edge of the surface 65 on which the sheets would be capable of coming to abut and suffering damage to their corners during their loading into the tray, and, secondly, to finalise the alignment of the sheets, before they enter the space existing between the two vertically oriented guide surfaces 65.

The arrangement of the pivoting means of the lid 13 on the bin 11 used in the preferred embodiment will now be described with the assistance of FIGS. 9 and 10.

During the development of his new tray, the applicant was confronted with a problem. In fact, in FIGS. 2, 3 and 5 it is noted that when the lid is open, it is kept in this position by the oblique abutment 80, on which it rests over a very small portion of its length. Its rear end 45 is at a fairly great distance from the pivoting axis 14, in the region of the length of the sheets having to be loaded into the bin (roughly 29 cm). There is therefore a large lever arm formed by the distance between the rear end 45 of the lid and an upper ridge 81 forming the upper limit of the abutment 80. Consequently, if a force in the direction of arrow F (FIG. 3) is exerted in the vicinity of the rear end 45, it is capable of exerting a large moment on the lid and the articulation at the level of the axis 14 is subject to a stress in the direction of arrow F'. If the articulation at the level of axis 14 is rigid, the moment exerted by the force F may have the result of breaking the lid, especially if it is made of a relatively fine plexiglass plate which consequently is fragile. Such a situation may arrive if a less careful user opens the lid abruptly, with a tendency to drive the latter beyond the abutment 80.

In order to overcome this drawback, and generally according to another aspect of the invention, the pivoting means are adapted to be separated automatically in the event of an impact of predetermined force exerted on the lid, the latter thereby being disconnected from the housing.

Figure 10:
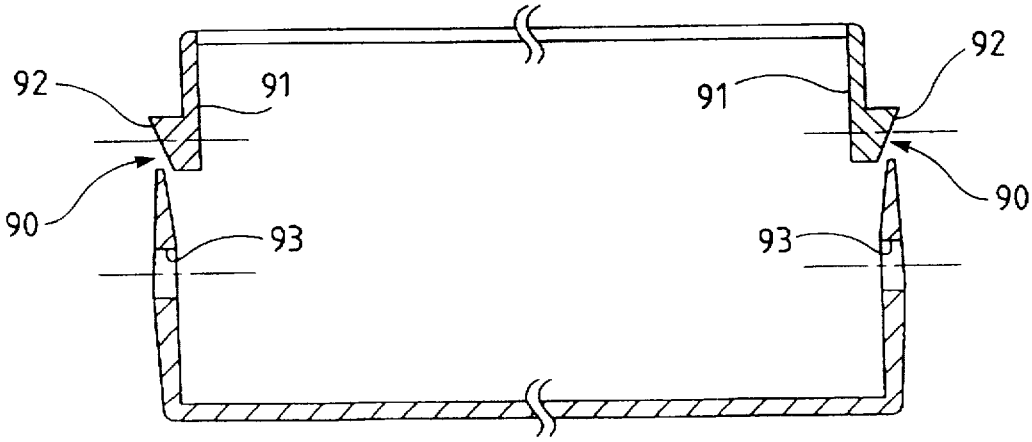
FIG. 10 is a sectional view along line X—X of FIG. 4, the lid being represented separated from the bin.

According to a preferred embodiment of this aspect of the invention, which is particularly advantageous in that it is simple and not very costly to put into use, the pivoting means of the lid about the said axis includes a pivot 90 arranged at each side of the lid 13 on a lateral elastic lug 91, the pivot 90 having a disengagement slope 92 oriented obliquely with respect to the axis of the pivot (cf. FIG. 10). Each lateral elastic lug 91 constitutes here one arm of a portion of the lid 13 forming a fork, the second arm of which is constituted by the arm 57.

In a complementary manner, a cylindrical housing 93 having dimensions complementary to the pivot 90 is provided in the wall 16, on the inner side thereof, the cylindrical housing having the axis 14 as its axis.

On FIG. 10 it is noted that the slopes 92 arranged on the pivots on either side of the lid are overall oriented towards one another and are at their closest in the vicinity of the lower end of the elastic lugs 91.

In this particular case the slopes 92 have a double function:

to facilitate the snapping-in of the pivot 90 into the housing 93, and to facilitate the disengagement of the pivot in the event of impacts on the lid in the direction of the arrow F (FIG. 3). In fact it is seen that the slopes 92 are substantially oriented in the direction of arrow F' (when the lid 13 is open) so as to facilitate the dismantling of the pivot means formed by the pivots 90 and housing 93 (direction of arrow F') in FIG. 3.

In the chosen embodiment represented on the figures, in accordance with another characteristic of this aspect of the invention, a snapping-in slope 95 provided on the inner side of the wall 16 is provided directly above the cylindrical housing 93, in order to facilitate the snapping-in of the pivot 90 in the housing 93 by a guiding of this pivot and a regular flexion of the lug 91, and also the accidental dismantling of the pivoting means further to a shock on the lid.

Obviously one will be able to provide other embodiments for the pivoting means of the lid 13 on the bin 11 capable of becoming separated in the event of impacts on the lid in the direction of arrow F of FIG. 3.

Of course the present invention is in no way restricted to the chosen embodiment represented on the figures but on the contrary includes all the variants within the scope of the man skilled in the art.

In particular it will be possible to replace the bin by any other type of receptacle, for example a bottom from which protrude studs for retaining the sheets by their edges.

In other respects, if the lid is mounted on the bin at the rear end thereof, opposite the feeding end, the predetermined distance relative to the limitation area will simply be that between this area and the bottom of the bin if the lifting plate does not extend as far as the rear end of the bin.

We claim:

1. A tray for loading sheets for a sheet-processing apparatus, comprising:

a sheet holding means for holding the sheets, the sheet holding means having a bin;

a lifting plate, movable between a low position and a high position, located within said sheet holding means;

an elastic member for urging said lifting plate to the high position from the low position;

a lid mounted on said sheet holding means, pivoting about an axis and movable between an open position and a closed position;

at least one arm integral with said lid for pushing said lifting plate toward the low position against an elastic force of said elastic member when said lid moves into the open position; and at least one abutment portion integral with said sheet holding means defining an oblique rest position of said lid by abutting said lid when said lid is in the open position, wherein the elastic force of said elastic member urges said lid toward said at least one abutment portion via said lifting plate and said at least one arm such that said lid is maintained in the open position.

2. A tray according to claim 1, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

3. A tray according to claim 1, wherein said lid is pivotably mounted in the bin about an axis by snapping-in means for snapping in said lid to engage with the bin, including a pivot arranged on each side of said lid on an elastic lug, a sloped disengagement surface arranged on each pivot and oriented obliquely with respect to an axis of the pivot, a cylindrical housing for each pivot, formed in a lateral wall of the bin and having the pivot as its axis, so that said lid can be disconnected from the bin in the event of an impact of a predetermined force exerted on said lid.

4. A tray according to claim 3, wherein a sloped snapping-in surface is arranged directly above each cylindrical housing, and is oriented in a direction of mounting of said lid.

5. A tray according to claim 4, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

6. A tray according to claim 3, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

7. A tray according to claim 1, further comprising a tab integral with said sheet holding means adjacent to the abutment portion, said tab having a holding surface to hold the sheets on said lifting plate after a loading operation.

8. A tray according to claim 7, wherein said tab is provided on a feeding end of said sheet holding means such that said tab holds a front corner of the sheets.

9. A tray for loading sheets for a sheet-processing apparatus, comprising:

sheet holding means for holding the sheets;

a lifting plate, movable between a low position and a high position, located within said sheet holding means;

an elastic member for urging said lifting plate to the high position from the low position;

a lid mounted on said sheet holding means pivoting about an axis and movable between an open position and a closed position;

means for mounting said lid on said sheet holding means about the axis so that said lid detaches from said sheet holding means without damage to said lid, said sheet holding means, and said mounting means when a predetermined force is applied to said lid;

pushing means for pushing said lifting plate toward the low position against an elastic force of said elastic member and maintaining said lid in the open position against the elastic force of said elastic member when said lid moves into the open position; and a limiting ridge on said lid for forming a limitation area when said lid is in the open position, wherein said limiting ridge is at a predetermined distance from a bottom of the sheet holding means, corresponding to a maximum thickness of sheets that can be loaded into the tray.

10. A tray according to claim 9, wherein said limiting ridge includes a contact surface having a substantial width, thereby preventing damage to a top sheet in the tray.

11. A tray according to claim 9, wherein said limiting ridge is integral with said lid and extends over an entire width of said lid.

12. A tray according to claim 11, wherein said limiting ridge includes a contact surface having a substantial width, thereby preventing damage to a top sheet in the tray.

13. A tray according to claim 9, wherein said mounting means comprises snapping-in means for snapping in said lid to engage with the sheet holding means, including a pivot arranged on each side of said lid on an elastic lug, a sloped disengagement surface arranged on each pivot and oriented obliquely with respect to an axis of the pivot, a cylindrical housing for each pivot, formed in a lateral wall of the sheet holding means and having the pivot as its axis, so that said lid can be disconnected from said sheet holding means without damage to said lid, said sheet holding means, and said mounting means in the event of an impact of the predetermined force exerted on said lid.

14. A tray according to claim 13, wherein a sloped snapping-in surface is arranged directly above each cylindrical housing, and is oriented in a direction of mounting of said lid.

15. An image forming apparatus, comprising:

a tray, said tray including:

a sheet holding means for holding sheets, the sheet holding means having a bin;

a lifting plate, movable between a low position and a high position, located within said sheet holding means;

an elastic member for urging said lifting plate to the high position from the low position;

a lid mounted on said sheet holding means, pivoting about an axis and movable between an open position and a closed position;

at least one arm integral with said lid for pushing said lifting plate toward the low position against an elastic force of said elastic member when said lid moves into the open position; and at least one abutment portion integral with said sheet holding means defining an oblique rest position of said lid by abutting said lid when said lid is in the open position, wherein the elastic force of said elastic member urges said lid toward said at least one abutment portion via said lifting plate and said at least one arm such that said lid is maintained in the open position;

feeding means for separating and feeding a sheet from said tray; and printing means for printing an image onto the sheet fed by said feeding means.

16. An image forming apparatus according to claim 15, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

17. An image forming apparatus according to claim 15, wherein said lid is pivotably mounted in the bin about an axis by snapping-in means for snapping in said lid to engage with the bin, including a pivot arranged on each side of said lid on an elastic lug, a sloped disengagement surface arranged on each pivot and oriented obliquely with respect to an axis of the pivot, a cylindrical housing for each pivot, formed in a lateral wall of the bin and having the pivot as its axis, so that said lid can be disconnected from the bin in the event of an impact of a predetermined force exerted on said lid.

18. An image forming apparatus according to claim 17, wherein a sloped snapping-in surface is arranged directly above each cylindrical housing, and is oriented in a direction of mounting of said lid.

19. An image forming apparatus according to claim 18, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

20. An image forming apparatus according to claim 17, wherein said lid has a limiting ridge extending across a width of said lid, and located such that when said lid is in the open position, the limiting ridge is at a predetermined distance from a bottom of said sheet holding means, corresponding to a maximum thickness of sheets that can be loaded into the tray.

21. An image forming apparatus according to claim 15, further comprising a tab integral with said sheet holding means adjacent to the abutment portion, said tab having a holding surface to hold the sheets on said lifting plate after a loading operation.

22. An image forming apparatus according to claim 21, wherein said tab is provided on a feeding end of said sheet holding means such that said tab holds a front corner of the sheets.

23. An image forming apparatus, comprising:

a tray, said tray including:

sheet holding means for holding sheets;

a lifting plate, movable between a low position and a high position, located within said sheet holding means;

an elastic member for urging said lifting plate to the high position from the low position;

a lid mounted on said sheet holding means pivoting about an axis and movable between an open position and a closed position;

means for mounting said lid on said sheet holding means about the axis so that said lid detaches from said sheet holding means without damage to said lid, said sheet holding means, and said mounting means when a predetermined force is applied to said lid;

pushing means for pushing said lifting plate toward the low position against an elastic force of said elastic member and maintaining said lid in the open position against the elastic force of said elastic member when said lid moves into the open position; and a limiting ridge on said lid for forming a limitation area when said lid is in the open position, wherein said limiting ridge is at a predetermined distance from a bottom of the sheet holding means, corresponding to a maximum thickness of sheets that can be loaded into the tray;

feeding means for separating and feeding a sheet from said tray; and printing means for printing an image onto the sheet fed by said feeding means.

24. An image forming apparatus according to claim 23, wherein said limiting ridge includes a contact surface having a substantial width, thereby preventing damage to a top sheet in the tray.

25. An image forming apparatus according to claim 23, wherein said limiting ridge is integral with said lid and extends over an entire width of said lid.

26. An image forming apparatus according to claim 25, wherein said limiting ridge includes a contact surface having a substantial width, thereby preventing damage to a top sheet in the tray.

27. An image forming apparatus according to claim 23, wherein said mounting means comprises snapping-in means for snapping in said lid to engage with the sheet holding means, including a pivot arranged on each side of said lid on an elastic lug, a sloped disengagement surface arranged on each pivot and oriented obliquely with respect to an axis of the pivot, a cylindrical housing for each pivot, formed in a lateral wall of the sheet holding means and having the pivot as its axis, so that said lid can be disconnected from said sheet holding means without damage to said lid, said sheet holding means, and said mounting means in the event of an impact of the predetermined force exerted on said lid.

28. A tray according to claim 27, wherein a sloped snapping-in surface is arranged directly above each cylindrical housing, and is oriented in a direction of mounting of said lid.

* * * * *

UNITED STATES PATENT AND TRADEMARK OFFICE

CERTIFICATE OF CORRECTION

PATENT NO. : 5,752,696

DATED : May 19, 1998

INVENTOR(S) : Noboru NAKATANI, et al.

It is certified that error appears in the above-identified patent and that said Letters Patent is hereby corrected as shown below:

COLUMN 14:

Line 29, "and" should be deleted; and
Line 62, "A tray" should read --An image forming apparatus--.

Signed and Sealed this

Nineteenth Day of January, 1999

*Attest:*

*Attesting Officer*

*Acting Commissioner of Patents and Trademarks*